US011132967B2

(12) United States Patent
Nakanishi et al.

(10) Patent No.: US 11,132,967 B2
(45) Date of Patent: Sep. 28, 2021

(54) LIQUID CRYSTAL DISPLAY DEVICE HAVING SUPERPOSED DISPLAY PANELS

(71) Applicants: Panasonic Liquid Crystal Display Co., Ltd., Himeji (JP); Pasona Knowledge Partner Inc., Osaka (JP)

(72) Inventors: Hideyuki Nakanishi, Osaka (JP); Toshikazu Koudo, Hyogo (JP); Katsuhiro Kikuchi, Osaka (JP)

(73) Assignees: PANASONIC LIQUID CRYSTAL DISPLAY CO., LTD., Hyogo (JP); PASONA KNOWLEDGE PARTNER INC., Osaka (JP)

( * ) Notice: Subject to any disclaimer, the term of this patent is extended or adjusted under 35 U.S.C. 154(b) by 0 days.

(21) Appl. No.: 16/790,261

(22) Filed: Feb. 13, 2020

(65) Prior Publication Data

US 2021/0256924 A1 Aug. 19, 2021

(51) Int. Cl.

| | |
|---|---|
| ***G09G 5/00*** | (2006.01) |
| ***G09G 3/36*** | (2006.01) |
| ***G09G 5/06*** | (2006.01) |

(52) U.S. Cl.

CPC ..... *G09G 3/3648* (2013.01); *G09G 5/06* (2013.01); *G09G 2320/0646* (2013.01); *G09G 2360/04* (2013.01); *G09G 2360/144* (2013.01)

(58) Field of Classification Search

CPC .. G09G 3/3648; G09G 5/06; G09G 2360/144; G09G 2360/04; G09G 2320/0646

See application file for complete search history.

(56) References Cited

U.S. PATENT DOCUMENTS

| | | | | |
|---|---|---|---|---|
| 2008/0088649 | A1* | 4/2008 | Ikeno | G09G 3/3611 345/690 |
| 2009/0051707 | A1* | 2/2009 | Hirata | G09G 3/3648 345/690 |
| 2009/0109351 | A1* | 4/2009 | Shiomi | G09G 3/3648 348/790 |
| 2018/0059465 | A1* | 3/2018 | Koudo | G09G 3/3648 |
| 2018/0151103 | A1* | 5/2018 | Koudo | G09G 3/3648 |
| 2018/0286325 | A1* | 10/2018 | Koudo | G09G 3/3688 |

FOREIGN PATENT DOCUMENTS

WO 2007/040139 4/2007

* cited by examiner

*Primary Examiner* — Adam J Snyder
(74) *Attorney, Agent, or Firm* — Hamre, Schumann, Mueller & Larson, P.C.

(57) ABSTRACT

A liquid crystal display device having a plurality of display panels disposed in a superposed manner, comprising: a first display panel that displays a first image; a second display panel disposed on a back surface side of the first display panel to display a second image; and an image processor that generates first image data for the first image and second image data for the second image based on the input image data, wherein the image processor includes: a differential filter that performs differential filter processing on a luminance signal calculated from the input image data and outputs a differential detection value; a background level detection circuit that detects a background level using the luminance signal; a gain determination circuit that determines a filter gain using the differential detection value and the background level; and a low-pass filter that performs low-pass filter processing using the filter gain.

6 Claims, 12 Drawing Sheets

LIQUID CRYSTAL DISPLAY DEVICE HAVING SUPERPOSED DISPLAY PANELS

BACKGROUND

1. Technical Field

The present disclosure relates to a liquid crystal display device.

2. Description of the Related Art

Conventionally, a technique, in which two display panels overlap each other and an image is displayed on each display panel based on input image data, is proposed as a technique of improving contrast of the liquid crystal display device (for example, see International Publication No. WO2007/040139). As a specific example, a color image is displayed on a first display panel disposed on a display surface side in two display panels disposed to be superposed on each other, and a monochrome image is displayed on a second display panel disposed on a back surface side, thereby improving the contrast. In the liquid crystal display device, low-pass filter processing (smoothing processing) of locally expanding a portion having a high signal level of the input image data by several pixels is performed on a video signal supplied to the second display panel on the back surface side in order to reduce a display defect due to parallax.

SUMMARY

However, in the conventional liquid crystal display device, the display defect due to the parallax is insufficiently reduced. That is, in the conventional configuration, because a filter coefficient of the low-pass filter processing is determined regardless of a background level in the input image data, the filter coefficient is not always appropriate, and the display defect due to the parallax is insufficiently reduced.

The present disclosure has been made in view of the above circumstance, and an object of the present disclosure is to further prevent the display defect due to the parallax in the liquid crystal display device in which the plurality of display panels are superposed on each other.

To solve the above problem, a liquid crystal display device that is a display device in which a plurality of display panels are disposed in a superposed manner and an image is displayed on each of the display panels according to a present disclosure comprises: a first display panel that displays a first image; a second display panel disposed on a back surface side of the first display panel to display a second image; and an image processor that acquires input image data and generates first image data corresponding to the first image and second image data corresponding to the second image based on the input image data, wherein the image processor includes: a differential filter that performs differential filter processing on a luminance signal calculated from the input image data and outputs a differential detection value; a background level detection circuit that detects a background level using the luminance signal; a gain determination circuit that determines a filter gain using the differential detection value output from the differential filter and the background level detected by the background level detection circuit; and a low-pass filter that performs low-pass filter processing using the filter gain determined by the gain determination circuit.

The present disclosure can prevent the display defect due to the parallax in the liquid crystal display device in which the plurality of display panels are superposed on each other.

DETAILED DESCRIPTION

Hereinafter, an exemplary embodiment of the present disclosure will be described with reference to the drawings. A liquid crystal display device according to an exemplary embodiment includes a plurality of display panels that display images, a plurality of drive circuits (a plurality of source drivers and a plurality of gate drivers) that drive the display panels, a plurality of timing controllers that control the driving circuits, an image processor that performs image processing on input image data input from an outside and outputs image data to each of the timing controllers, and a backlight that irradiates the plurality of display panels with light from a back surface side. There is no limitation to a number of display panels, but it is only necessary to provide at least two display panels. When viewed from the observer side, the plurality of display panels are disposed while superposed on each other in a front-back direction. An image is displayed on each of the display panels. Liquid crystal display device 10 including two display panels will be described below by way of example.

Figure 1:
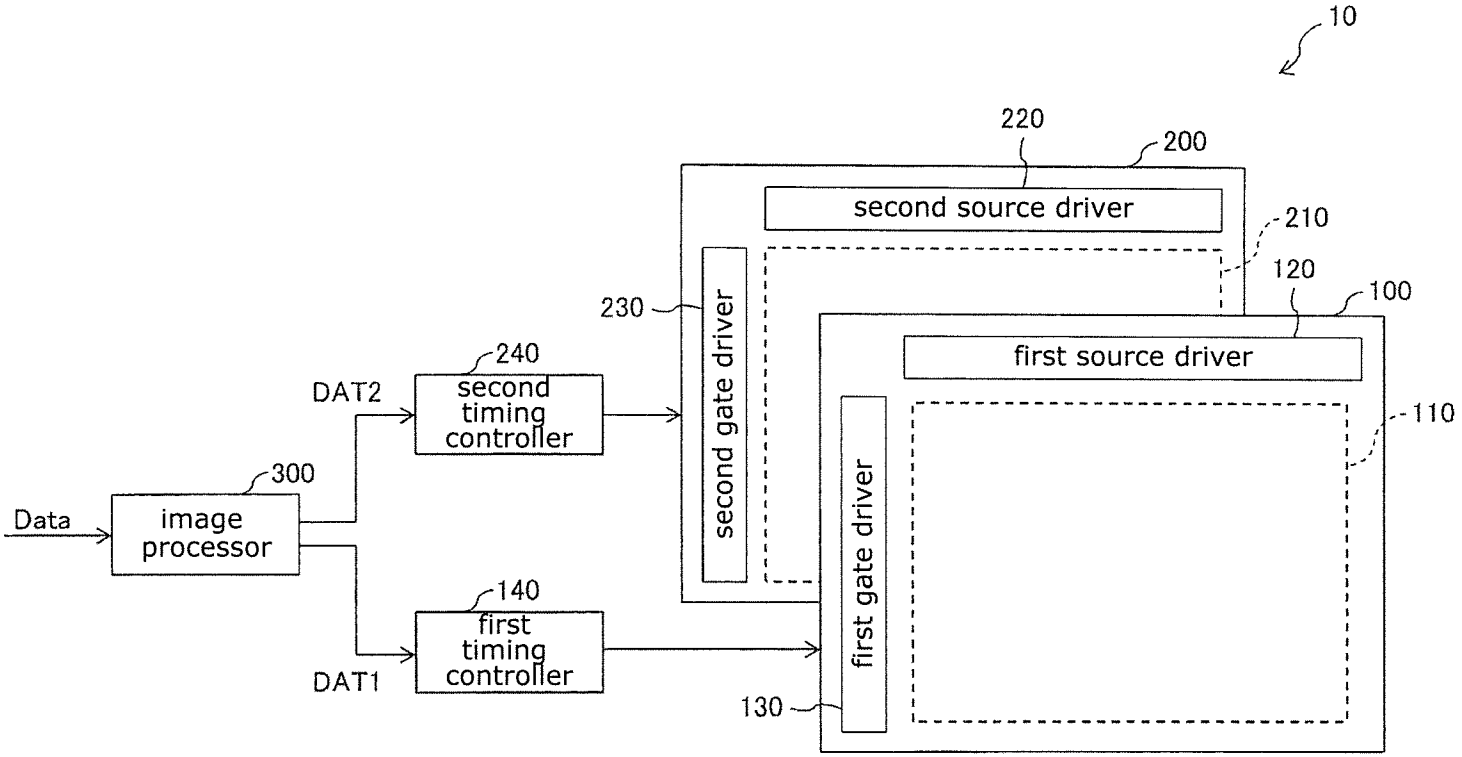
FIG. 1 is a schematic diagram illustrating a schematic configuration of a liquid crystal display device according to an exemplary embodiment.

FIG. 1 is a schematic diagram illustrating a configuration of liquid crystal display device 10 of the exemplary embodiment. As illustrated in FIG. 1, liquid crystal display device 10 includes first display panel 100 disposed on a display surface side of whole liquid crystal display device 10, second display panel 200 disposed closer to the back surface side than first display panel 100, first timing controller 140 that controls first source driver 120 and first gate driver 130 provided in first display panel 100, second timing controller 240 that controls second source driver 220 and second gate driver 230 provided in second display panel 200, and image processor 300 that outputs image data to first timing controller 140 and second timing controller 240. In first display panel 100, a first image (in the exemplary embodiment, a color image) corresponding to first image data generated based on the input image data is displayed in first image display region 110. In second display panel 200, the second image (in the exemplary embodiment, a monochrome image) corresponding to second image data generated based on the input image data is displayed in second image display region 210. Image processor 300 receives input image data Data transmitted from an external system (not illustrated), performs image processing (to be described later) on input image data Data, outputs first image data DAT1 to first timing controller 140, and outputs second image data DAT2 to second timing controller 240. Image processor 300 also outputs control signals (not illustrated in FIG. 1) such as a synchronizing signal to first timing controller 140 and second timing controller 240. First image data DAT1 is image data for displaying the first image, and second image data DAT2 is image data for displaying the second image. A backlight (not illustrated in FIG. 1) is disposed on the back surface side of second display panel 200. A specific configuration of image processor 300 will be described later. In the exemplary embodiment, an example in which the first image is the color image will be described. However, the first image may be the monochrome image.

Figure 2:
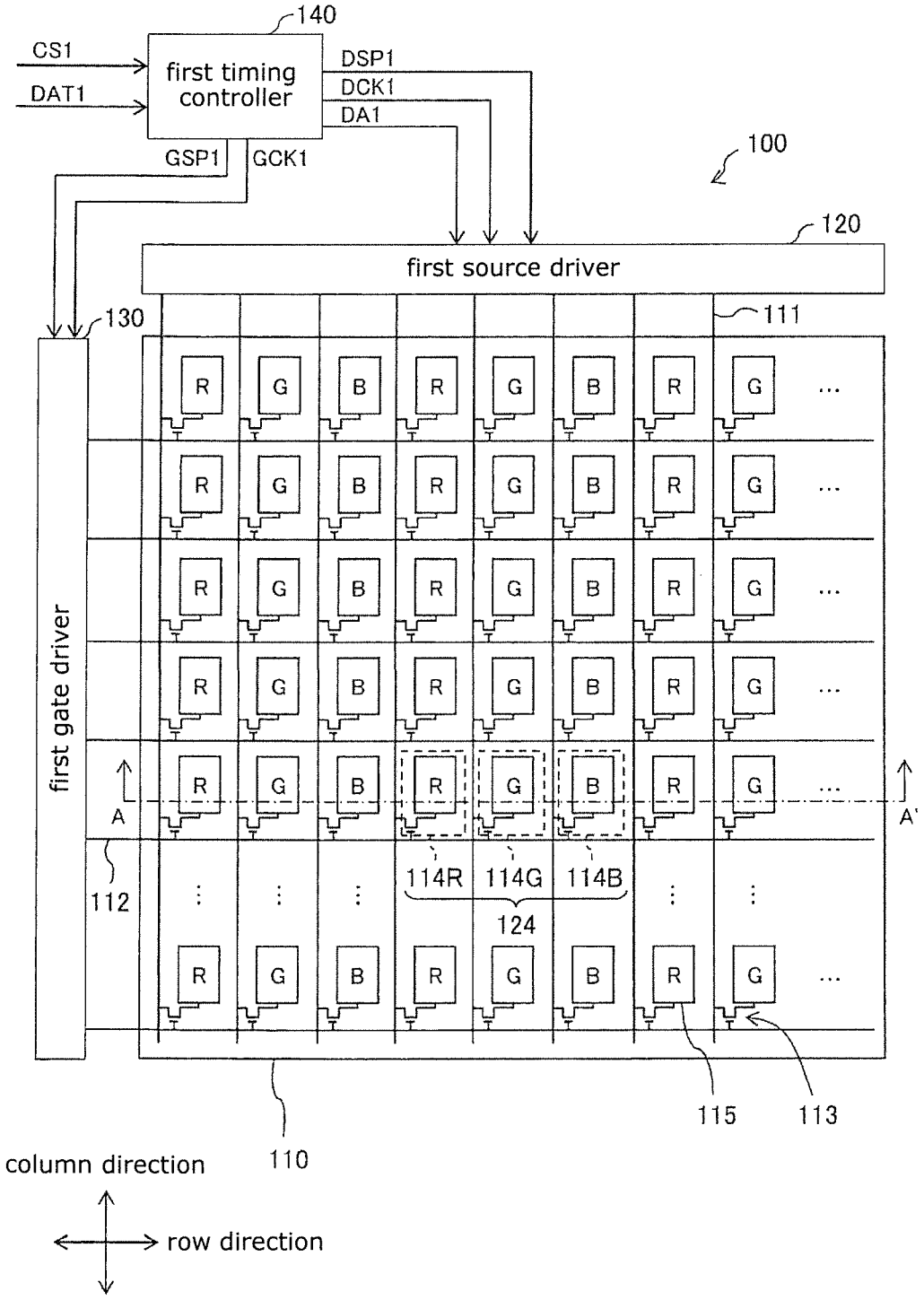
FIG. 2 is a schematic diagram illustrating a schematic configuration of a first display panel of the exemplary embodiment.
Figure 3:
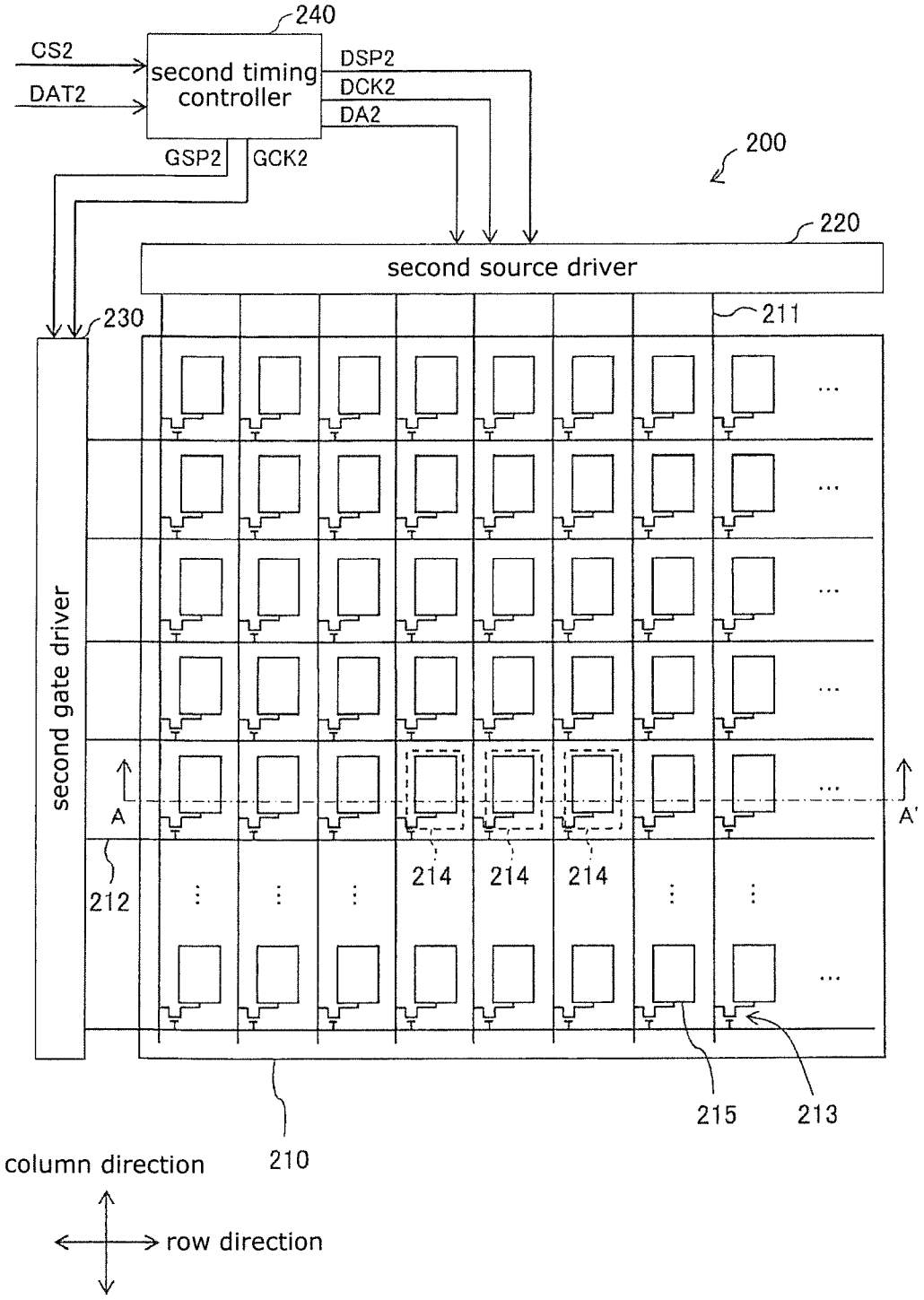
FIG. 3 is a schematic diagram illustrating a schematic configuration of a second display panel of the exemplary embodiment.
Figure 4:
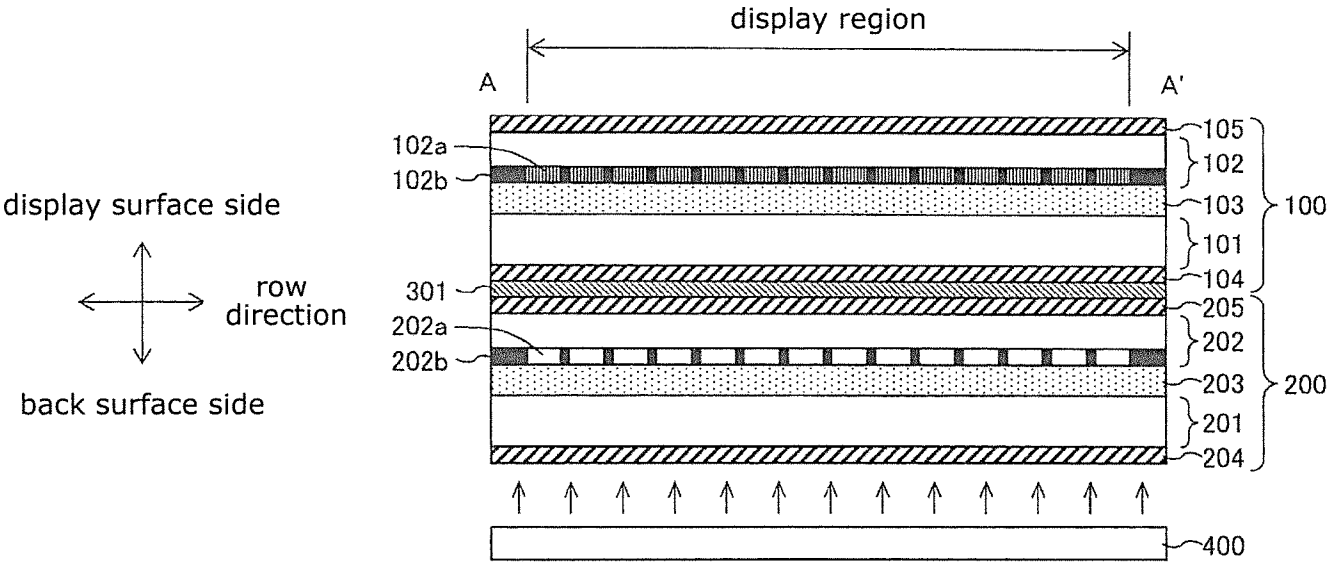
FIG. 4 is a sectional view taken along a line A-A' in FIGS. 2 and 3.

FIG. 2 is a schematic diagram illustrating a configuration of first display panel 100, and FIG. 3 is a schematic diagram illustrating a configuration of second display panel 200. FIG. 4 is a sectional view taken along a line A-A' in FIGS. 2 and 3.

The configuration of first display panel 100 will be described with reference to FIGS. 2 and 4. As illustrated in FIG. 4, first display panel 100 includes thin film transistor substrate (hereinafter, referred to as a TFT substrate) 101 disposed on the back surface side, namely, on the side of backlight 400, color filter substrate (hereinafter, referred to as a CF substrate) 102 that is disposed closer to the display surface side than TFT substrate 101 while opposed to TFT substrate 101, and liquid crystal layer 103 disposed between TFT substrate 101 and CF substrate 102. Polarizing plate 104 is disposed on the back surface side of first display panel 100, namely, on the side of backlight 400, and polarizing plate 105 is disposed on the display surface side.

In TFT substrate 101, as illustrated in FIG. 2, a plurality of data lines 111 extending in a first direction (for example, a column direction) and a plurality of gate lines 112 extending in a second direction (for example, a row direction) different from the first direction are formed, and thin film transistor (hereinafter, referred to as a TFT) 113 is formed near an intersection between each of the plurality of data lines 111 and each of the plurality of gate lines 112. In planar view of first display panel 100, a region surrounded by two data lines 111 adjacent to each other and two gate lines 112 adjacent to each other is defined as one subpixel 114, and a plurality of subpixels 114 are arranged in a matrix form (in the row and column directions). The plurality of data lines 111 are disposed at equal intervals in the row direction, and the plurality of gate lines 112 are disposed at equal intervals in the column direction. In TFT substrate 101, pixel electrode 115 is formed in each subpixel 114, and one common electrode (not illustrated) common to the plurality of subpixels 114 is formed. A drain electrode constituting TFT 113 is electrically connected to data line 111, a source electrode is electrically connected to pixel electrode 115, and a gate electrode is electrically connected to gate line 112.

As illustrated in FIG. 4, a plurality of colored portions 102*a* each of which corresponds to subpixel 114 are formed on CF substrate 102. Each colored portion 102*a* is surrounded by black matrix 102*b* blocking light transmission. For example, each colored portion 102*a* is formed into a rectangular shape. The plurality of colored portions 102*a* includes red portions made of a red material to transmit red light, green portions made of a green material to transmit green light, and blue portions made of a blue material to transmit blue light. The red portion, the green portion, and the blue portion are repeatedly arranged in this order in the row direction, the colored portions having the same color are arranged in the column direction, and black matrix 102*b* is formed at a boundary portion between colored portions 102*a* adjacent to each other in the row and column directions. As illustrated in FIG. 2, the plurality of subpixels 114 include red subpixels 114R corresponding to the red portions, green subpixels 114G corresponding to the green portions, and blue subpixels 114B corresponding to the blue portions according to colored portions 102*a*. In first display panel 100, one pixel 124 is constructed with one red subpixel 114R, one green subpixel 114G, and one blue subpixel 114B, and a plurality of pixels 124 are arranged in a matrix form.

First timing controller 140 has a known configuration. For example, based on first image data DAT1 and first control signal CS1 (such as a clock signal, a vertical synchronizing signal, and a horizontal synchronizing signal) output from image processor 300, first timing controller 140 generates first image data DA1 and various timing signals (data start pulse DSP1, data clock DCK1, gate start pulse GSP1, and gate clock GCK1) in order to control drive of first source driver 120 and first gate driver 130 (see FIG. 2). First timing controller 140 outputs first image data DA1, data start pulse DSP1, and data clock DCK1 to first source driver 120, and outputs gate start pulse GSP1 and gate clock GCK1 to first gate driver 130.

First source driver 120 outputs a data signal (data voltage) corresponding to first image data DA1 to data lines 111 based on data start pulse DSP1 and data clock DCK1. First gate driver 130 outputs a gate signal (gate voltage) to gate lines 112 based on gate start pulse GSP1 and gate clock GCK1.

The data voltage is supplied from first source driver 120 to each data line 111, and the gate voltage is supplied from first gate driver 130 to each gate line 112. A common voltage is supplied from a common driver (not illustrated) to the common electrode. When the gate voltage (gate-on voltage) is supplied to gate line 112, TFT 113 connected to gate line 112 is turned on, and the data voltage is supplied to pixel electrode 115 through data line 111 connected to TFT 113. An electric field is generated by a difference between the data voltage supplied to pixel electrode 115 and the common voltage supplied to the common electrode. The liquid crystal is driven by the electric field to control the transmittance of light from backlight 400, thereby displaying the image. In first display panel 100, the color image is displayed by supply of a desired data voltage to data line 111 connected to pixel electrode 115 of each of red subpixel 114R, green subpixel 114G, and blue subpixel 114B. A known configuration can be applied to first display panel 100.

The configuration of second display panel 200 will be described below with reference to FIGS. 3 and 4. As illustrated in FIG. 4, second display panel 200 includes TFT substrate 201 disposed on the back surface side, namely, on the side of backlight 400, CF substrate 202 that is disposed on the display surface side while opposed to TFT substrate 201, and liquid crystal layer 203 disposed between TFT substrate 201 and CF substrate 202. Polarizing plate 204 is disposed on the back surface side of second display panel 200, namely, on the side of backlight 400, and polarizing plate 205 is disposed on the display surface side. Diffusion sheet 301 is disposed between polarizing plate 104 of first display panel 100 and polarizing plate 205 of second display panel 200.

Figure 5:
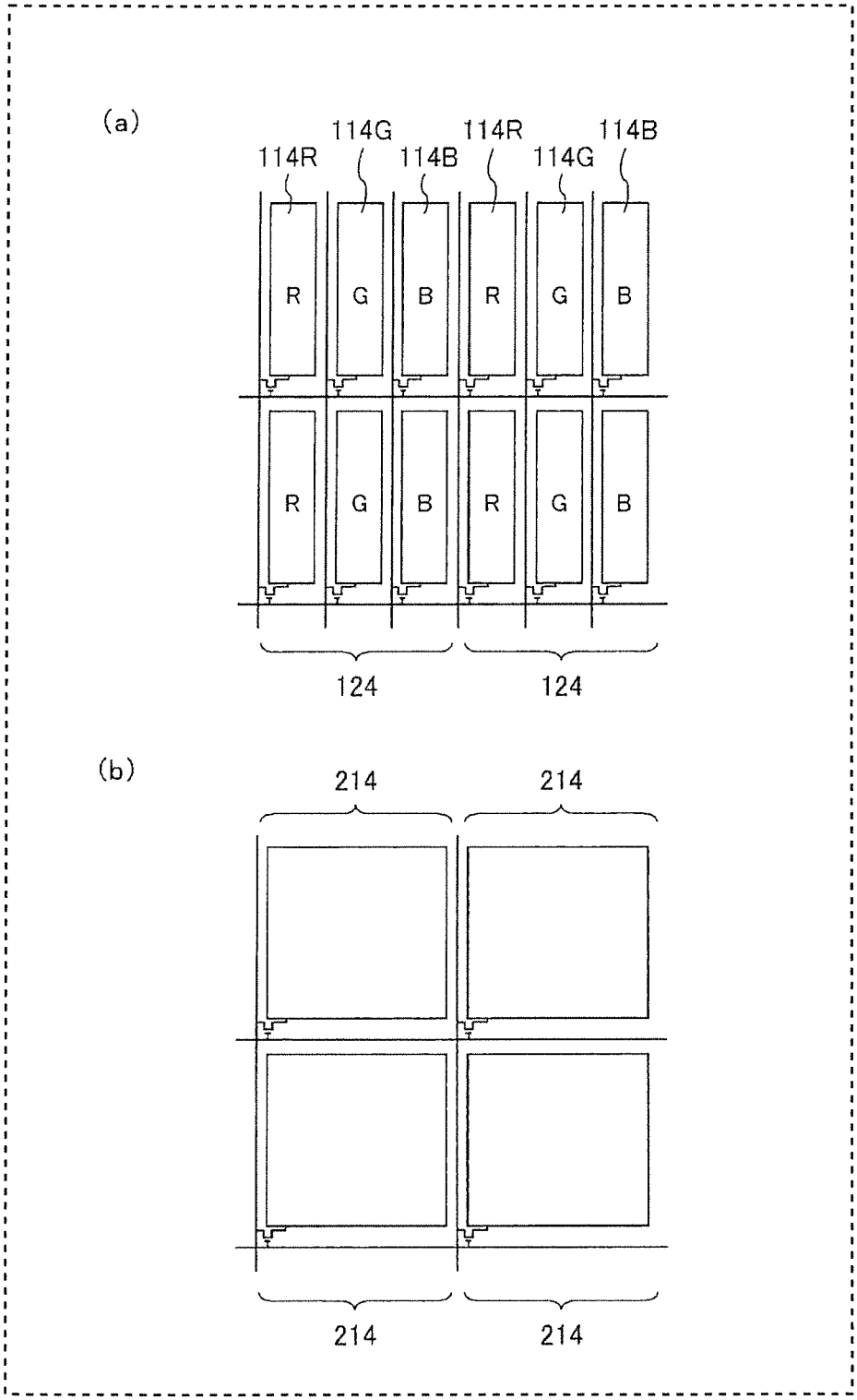
FIG. 5 is a schematic diagram illustrating a pixel arrangement example of a liquid crystal display device according to another example of the exemplary embodiment.

In TFT substrate 201, as illustrated in FIG. 3, a plurality of data lines 211 extending in the column direction, a plurality of gate lines 212 extending in the row direction are formed, and TFT 213 is formed near an intersection between each of the plurality of data lines 211 and each of the plurality of gate lines 212. In planar view of second display panel 200, a region surrounded by two data lines 211 adjacent to each other and two gate lines 212 adjacent to each other is defined as one pixel 214, and a plurality of pixels 214 are arranged in a matrix form (the row direction and the column direction). The plurality of data lines 211 are disposed at equal intervals in the row direction, and the plurality of gate lines 212 are disposed at equal intervals in the column direction. In TFT substrate 201, pixel electrode 215 is formed in each pixel 214, and one common electrode (not illustrated) common to the plurality of pixels 214 is formed. A drain electrode constituting TFT 213 is electrically connected to data line 211, a source electrode is electrically connected to pixel electrode 215, and a gate electrode is electrically connected to gate line 212. Each subpixel 114 of first display panel 100 and each pixel 214 of second display panel 200 are disposed in a one-to-one manner, and overlap each other in planar view. For example, red subpixel 114R, green subpixel 114G, and blue subpixel 114B, which constitute pixel 124 in FIG. 2, overlap three respective pixels 214 in FIG. 3 in planar view. As illustrated in FIGS. 5A and 5B, three subpixels 114 (red subpixel 114R, green subpixel 114G, and blue subpixel 114B) (see FIG. 5A) of first display panel 100 may overlap one pixel 214 (see FIG. 5B) of second display panel 200 in planar view.

As illustrated in FIG. 4, in CF substrate 202, black matrix 202*b* blocking light transmission is formed at a position corresponding to a boundary portion between pixels 214. The colored portion is not formed in region 202*a* surrounded by black matrix 202*b*. For example, an overcoat film is formed in region 202*a*.

Second timing controller 240 has a known configuration. For example, based on second image data DAT2 and second control signal CS2 (such as a clock signal, a vertical synchronizing signal, and a horizontal synchronizing signal) output from image processor 300, second timing controller 240 generates second image data DA2 and various timing signals (data start pulse DSP2, data clock DCK2, gate start pulse GSP2, and gate clock GCK2) in order to control drive of second source driver 220 and second gate driver 230 (see FIG. 3). Second timing controller 240 outputs second image data DA2, data start pulse DSP2, and data clock DCK2 to second source driver 220, and outputs gate start pulse GSP2 and gate clock GCK2 to second gate driver 230.

Second source driver 220 outputs the data voltage corresponding to second image data DA2 to data lines 211 based on data start pulse DSP2 and data clock DCK2. Second gate driver 230 outputs the gate voltage to gate lines 212 based on gate start pulse GSP2 and gate clock GCK2.

The data voltage is supplied from second source driver 220 to each data line 211, and the gate voltage is supplied from second gate driver 230 to each gate line 212. The common voltage is supplied from the common driver to the common electrode. When the gate voltage (gate-on voltage) is supplied to gate line 212, TFT 213 connected to gate line 212 is turned on, and the data voltage is supplied to pixel electrode 215 through data line 211 connected to TFT 213. The electric field is generated by the difference between the data voltage supplied to pixel electrode 215 and the common voltage supplied to the common electrode. The liquid crystal is driven by the electric field to control the transmittance of light from backlight 400, thereby displaying the image. The monochrome image is displayed on second display panel 200. A known configuration can be applied to second display panel 200.

Figure 6:
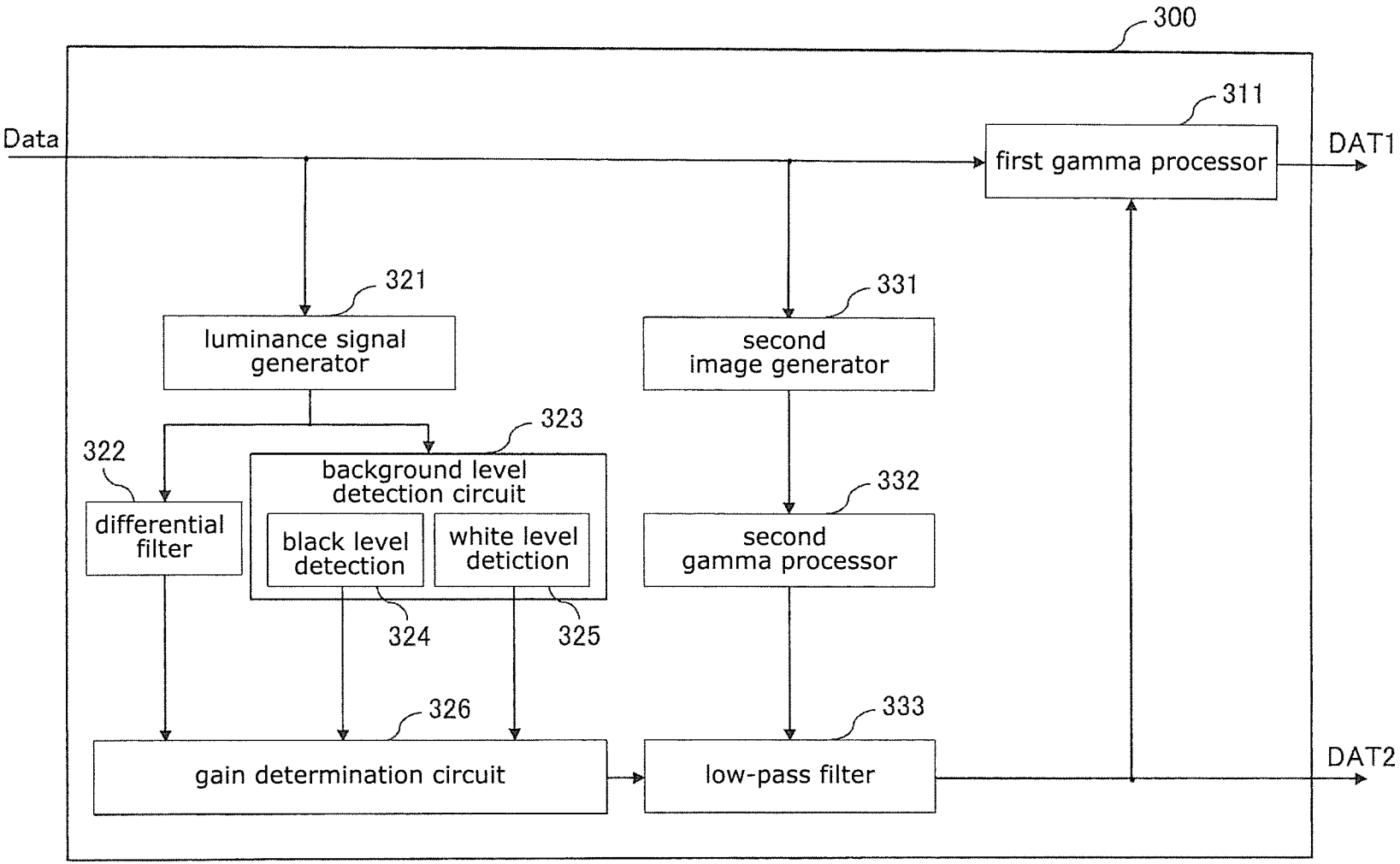
FIG. 6 is a block diagram illustrating a configuration of an image processor according to the exemplary embodiment.

FIG. 6 is a block diagram illustrating a specific configuration of image processor 300. Image processor 300 includes first gamma processor 311, luminance signal generator 321, differential filter 322, background level detection circuit 323, gain determination circuit 326, second image generator 331, second gamma processor 332, and low-pass filter 333. In the exemplary embodiment, background level detection circuit 323 includes black level detection circuit 324 and white level detection circuit 325. Based on input image data Data, image processor 300 performs the following image processing to generate first image data DAT1 (in the exemplary embodiment, the color image data) corresponding to the first image displayed on first display panel 100 and second image data DAT2 (in the exemplary embodiment, the monochrome image data) corresponding to the second image displayed on second display panel 200.

When receiving input image data Data transmitted from an external system, image processor 300 transmits input image data Data to first gamma processor 311, luminance signal generator 321, and second image generator 331. For example, input image data Data includes luminance information (gradation information) and color information. The color information is one designating the color. For example, in the case that input image data Data is constructed with 8 bits, each of a plurality of colors including the red color, the green color, and the blue color can be expressed by values of 0 to 255. The plurality of colors include at least the red color, the green color, and the blue color, and may further include a white color and/or a yellow color. The case that the plurality of colors include the red color, the green color, and the blue color is cited below by way of example. Hereinafter, the color information about input image data Data is referred to as an "RGB value" ([R value, G value, B value]). For example, in the case that the color corresponding to input image data Data is "white", the value (R value) of the red color is expressed by [255], the value (G value) of the green color is expressed by [255], and the value (B value) of the blue color is expressed by [255]. That is, the "RGB value" is expressed by [255, 255, 255]. The "RGB value" is expressed by [255, 0, 0] in the case that the color corresponding to input image data Data is "red", and the "RGB value" is expressed by [0, 0, 0] in the case that the color is "black".

When acquiring input image data Data, luminance signal generator 321 calculates luminance signal Y from the RGB values ([R value, G value, B value]) of input image data Data. For example, luminance signal Y can be calculated using the following known transform (1).

$$Y=0.299\times R \text{ value}+0.587\times G \text{ value}+0.114\times B \text{ value} \quad (1)$$

Luminance signal generator 321 outputs generated luminance signal Y to differential filter 322 and background level detection circuit 323.

When acquiring luminance signal Y from luminance signal generator 321, differential filter 322 performs differential filter processing on the luminance signal to detect an edge at which the luminance changes largely. For example, differential filter 322 performs the differential filter processing using a Prewitt filter or a Sobel filter. Differential filter 322 detects the edge having the large luminance change by the differential filter processing, and outputs a differential detection value indicating magnitude of the luminance change at the edge. A known method can be adopted as the differential filter processing. Differential filter 322 outputs the differential detection value to gain determination circuit 326.

Although a peak detection circuit can be used instead of differential filter 322, more preferably a filter gain is determined using the differential detection value indicating a difference between a background level and the luminance of a bright spot as compared with the case that the filter gain of the low-pass filter processing performed by low-pass filter 333 is determined using the peak value of the bright spot. For this reason, in the present disclosure, the description of the configuration in which image processor 300 includes differential filter 322 will be continued.

When acquiring the luminance signal Y from luminance signal generator 321, background level detection circuit 323 detects the background level using luminance signal Y. In the exemplary embodiment, background level detection circuit 323 includes black level detection circuit 324 and white level detection circuit 325, and black level detection circuit 324 and white level detection circuit 325 acquire luminance signal Y.

Figure 7:
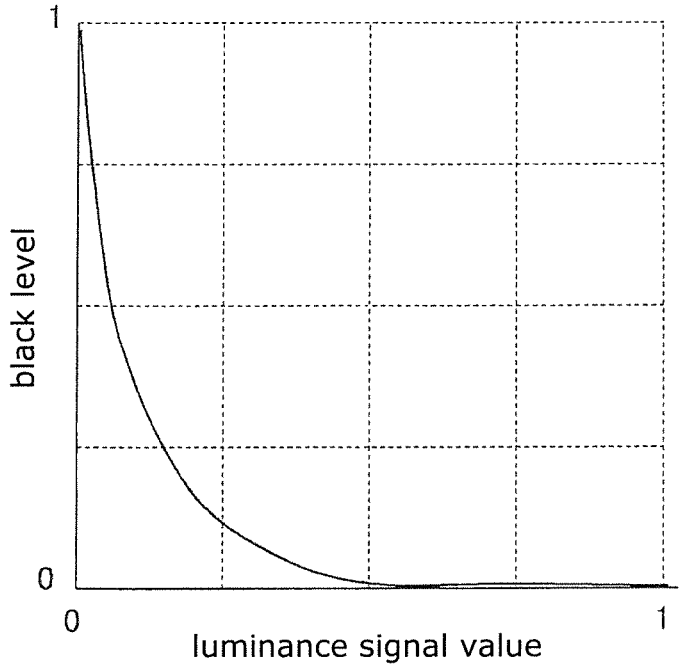
FIG. 7 is a graph illustrating an input and output example of a black level detection circuit according to the exemplary embodiment.
Figure 9:
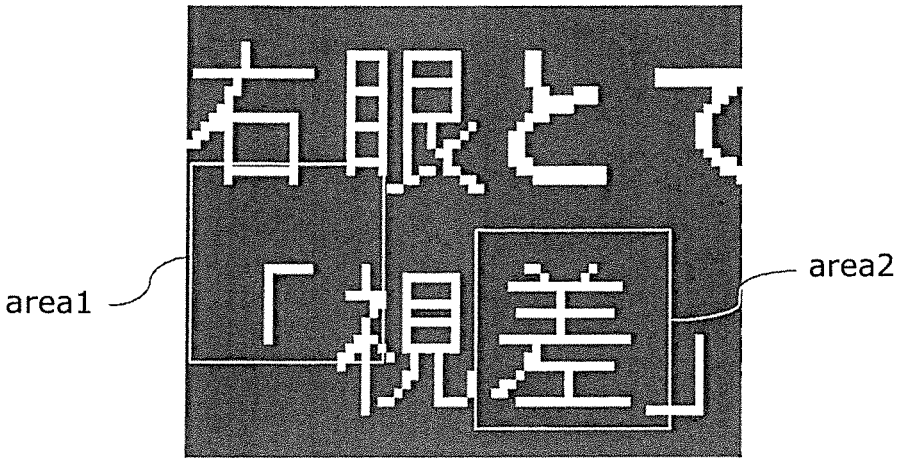
FIG. 9 is a conceptual diagram illustrating a processing example of the black level detection circuit according to the exemplary embodiment.
Figure 12:
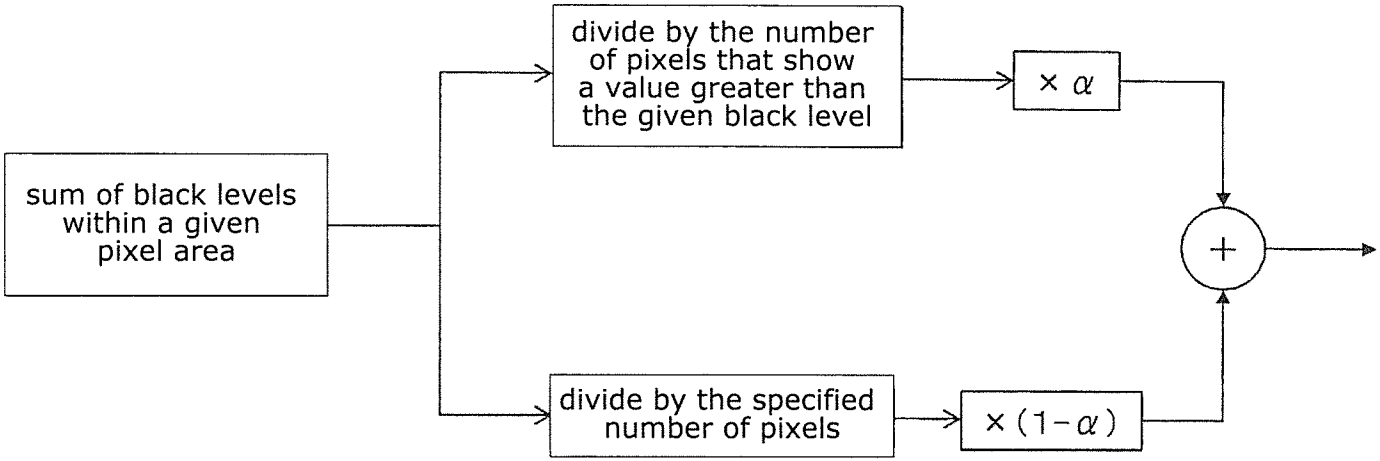
FIG. 12 is a block diagram illustrating a processing example of the black level detection circuit according to the exemplary embodiment.

Black level detection circuit 324 is a circuit that detects the background level on a black side within a predetermined pixel range, and outputs a larger value as the input image data is closer to a black level. FIG. 7 is a graph illustrating a value of the black level output from black level detection circuit 324 with respect to a value of luminance signal Y of each pixel. When the value of the luminance signal is zero, the highest value of 1 is output as the output value of the black level. Then, the output value of the black level decreases with increasing value of the luminance signal, and the output value as the black level becomes zero when the value of the luminance signal is less than 1, for example, around 0.5. When black level detection circuit 324 is used, an influence on the total value of the black levels is reduced even when a predetermined pixel range includes the bright spot having an extremely high luminance signal value, so that the total value of the black levels in the predetermined pixel range can be prevented from being lowered by being pulled by the value of the luminance signal of the bright spot. That is, for example, when at least one bright spot having the very high luminance exists in a predetermined pixel range in the case to use an average filter, there is a possibility that the average value of the luminance in the predetermined pixel range becomes high even when many black spots exist in the entire predetermined pixel range. However, black level detection circuit 324 can set the output value as the black level to zero regardless of the luminance level of all the bright spots, so that the total value of the black levels within a predetermined pixel range can be prevented from lowering. According to a graph in FIG. 7, black level detection circuit 324 converts the value of luminance signal Y of each pixel into the black level, and outputs the total value within a predetermined pixel range. Black level detection circuit 324 may output the black level as the total value within the predetermined pixel range as described above. Alternatively, for example, as illustrated in FIG. 9, when the same black level is output in a plurality of areas (for example, area 1 and area 2 in FIG. 9), an average value obtained by dividing the total value by the number of pixels having the value larger than a predetermined black level may be output in each area. As illustrated in FIG. 12, a value in which an average value obtained by dividing the total value by the number of pixels having the value larger than the predetermined black level is multiplied by weighting ($\alpha$) and a value in which a simple average value obtained by dividing the total value by the number of pixels in the predetermined pixel range is multiplied by weighting ($1-\alpha$) may be added according to the number of pixels having the value larger than the predetermined black level within the predetermined pixel range. For example, the predetermined black level is zero. At this point, the $\alpha$ value may be set to a relatively large value in a range of 0 to 1 when the number of pixels having the value larger than the predetermined black level is large in the predetermined pixel range, and the $\alpha$ value may be set to a relatively small value within the range of 0 to 1 when the number of pixels having the value larger than the predetermined black level is small in the predetermined pixel range.

Figure 8:
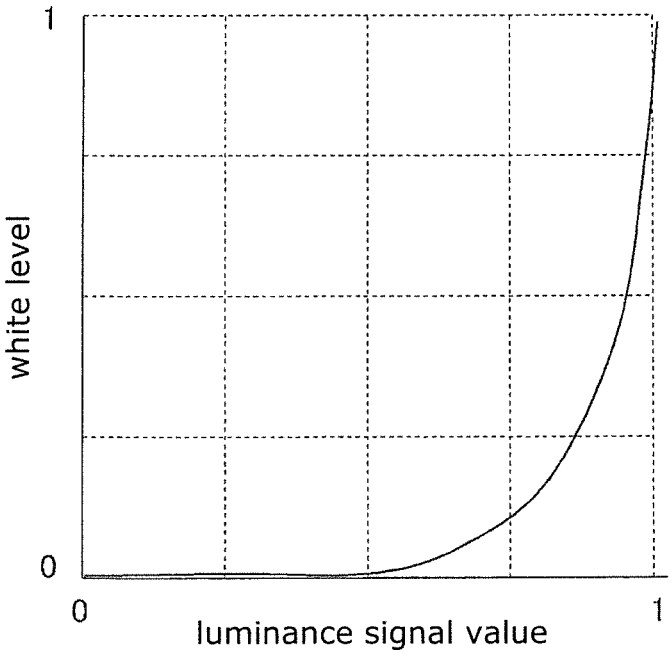
FIG. 8 is a graph illustrating an input and output example of a white level detection circuit according to the exemplary embodiment.
Figure 13:
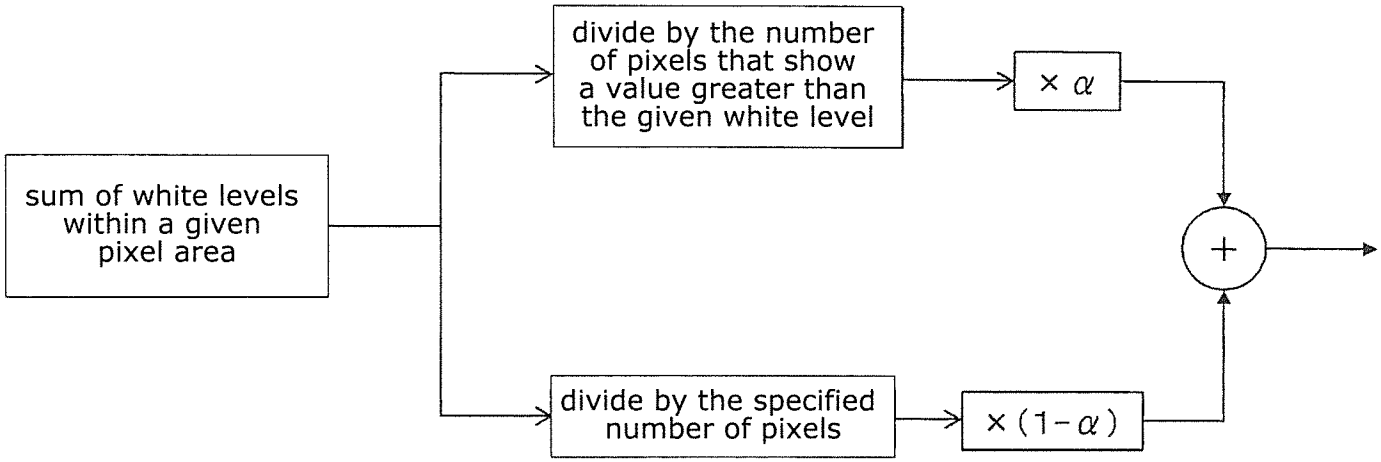
FIG. 13 is a block diagram illustrating a processing example of the white level detection circuit according to the exemplary embodiment.

White level detection circuit 325 is a circuit that detects the background level on a white side within a predetermined pixel range, and outputs a larger value as the input image data is closer to the white level. FIG. 8 is a graph illustrating a value of the white level output from white level detection circuit 325 with respect to the value of luminance signal Y of each pixel. When the value of the luminance signal is 1 that is the highest value, the value of 1 that is the highest value is output as the output value of the white level. The output value of the white level decreases with decreasing value of the luminance signal, and the output value as the white level becomes zero around, for example, 0.5 before the value of the luminance signal decreases to zero. When white level detection circuit 325 is used, an influence on the total value of the white levels is reduced even when a predetermined pixel range includes the black spot having an extremely low luminance signal value, so that the total value of the white levels in the predetermined pixel range can be prevented from being lowered by being pulled by the value of the luminance signal of the black spot. That is, for example, when at least one black spot having the very low luminance exists in a predetermined pixel range in the case to use an average filter, there is a possibility that the average value of the luminance in the predetermined pixel range becomes low even when many bright spots exist in the entire predetermined pixel range. However, white level detection circuit 325 can set the output value as the white level to zero regardless of the low luminance level of all the black spots, so that the total value of the white levels within a predetermined pixel range can be prevented from lowering. According to a graph in FIG. 8, white level detection circuit 325 converts the value of luminance signal Y of each pixel into the white level, and outputs the total value within a predetermined pixel range. White level detection circuit 325 may output the white level as the total value within the predetermined pixel range as described above. Alternatively, for example, when the same white level is output in a plurality of areas, an average value obtained by dividing the total value by the number of pixels having the value larger than a predetermined white level may be output in each area. As illustrated in FIG. 13, a value in which an average value obtained by dividing the total value by the number of pixels having the value larger than the predetermined white level is multiplied by weighting ($\alpha$) and a value in which a simple average value obtained by dividing the total value by the number of pixels in the predetermined pixel range is multiplied by weighting ($1-\alpha$) may be added according to the number of pixels having the value larger than the predetermined white level within the predetermined pixel range. For example, the predetermined white level is zero. At this point, the $\alpha$ value may be set to a relatively large value in a range of 0 to 1 when the number of pixels having the value larger than the predetermined white level is large in the predetermined pixel range, and the $\alpha$ value may be set to a relatively small value within the range of 0 to 1 when the number of pixels having the value larger than the predetermined white level is small in the predetermined pixel range.

Figure 10:
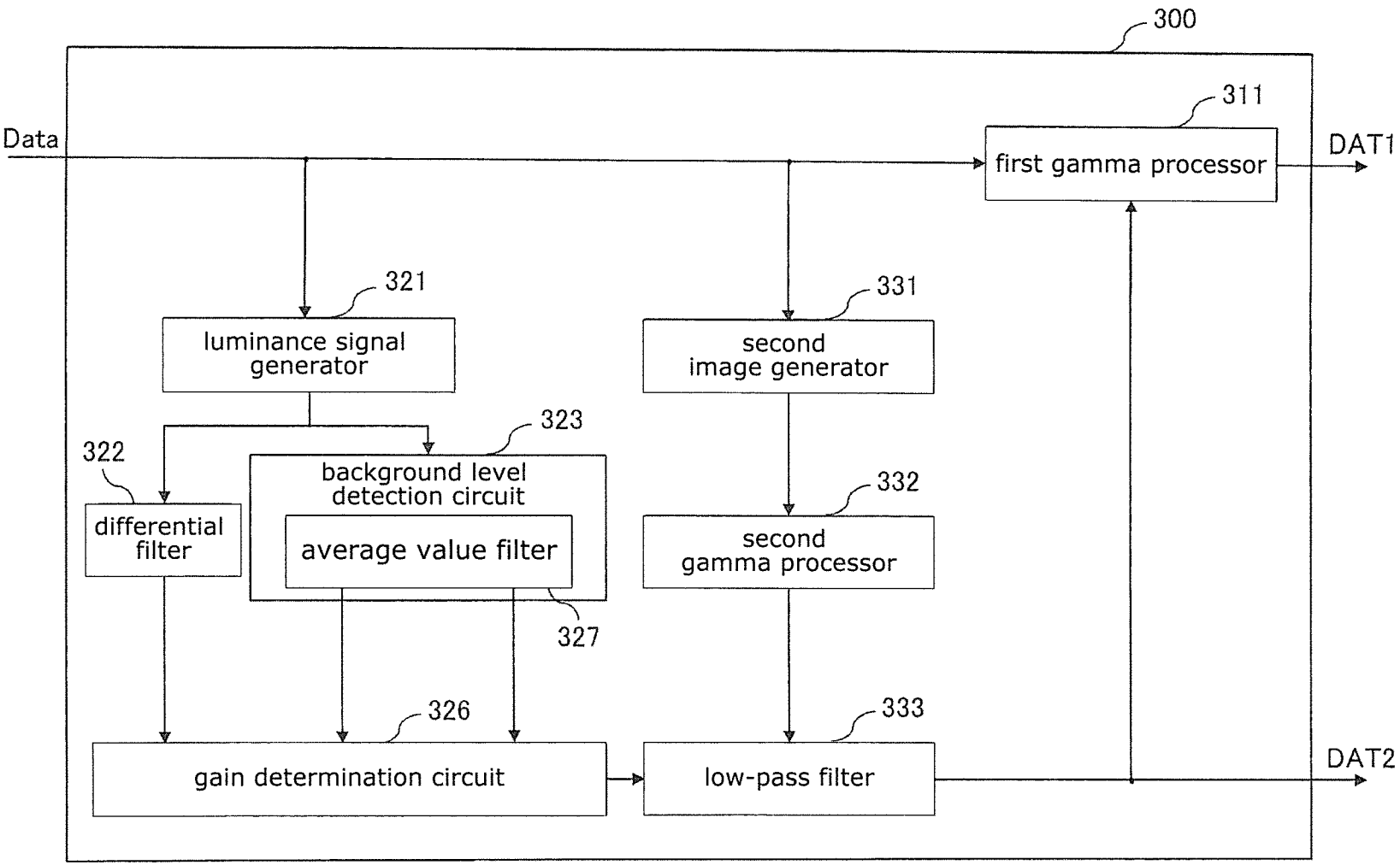
FIG. 10 is a block diagram illustrating a configuration of an image processor according to another example of the exemplary embodiment.

In the example of FIG. 6, background level detection circuit 323 includes black level detection circuit 324 and white level detection circuit 325. Alternatively, as illustrated in FIG. 10, background level detection circuit 323 may include average value filter 327 instead of black level detection circuit 324 and white level detection circuit 325. Average value filter 327 sets a pixel region in a predetermined range to a filter size, and outputs an average value of luminance within the filter size as the background level.

However, as illustrated in FIG. 6, when background level detection circuit 323 includes black level detection circuit 324 and white level detection circuit 325, desirably the background level can be detected with higher accuracy. That is, as described above, black level detection circuit 324 can set the output value as the black level to zero regardless of the high luminance level of all the bright spots, so that the total value of the black levels within a predetermined pixel range can be prevented from lowering. White level detection circuit 325 can set the output value as the white level to zero regardless of the low luminance level of all the black spots, so that the total value of the white levels within a predetermined pixel range can be prevented from lowering. For this reason, the background level can be detected with higher accuracy as compared with the configuration in which average value filter 327 is used as background level detection circuit 323. The description of the configuration in FIG. 6 in which background level detection circuit 323 includes black level detection circuit 324 and white level detection circuit 325 will be continued below.

Gain determination circuit 326 determines the filter gain of low-pass filter 333 using the differential detection value output from differential filter 322 and the background level detected by background level detection circuit 323. In the exemplary embodiment, gain determination circuit 326 determines the filter gain of low-pass filter 333 using the differential detection value output from differential filter 322, the output value from black level detection circuit 324, and the output value from white level detection circuit 325.

Figure 11:
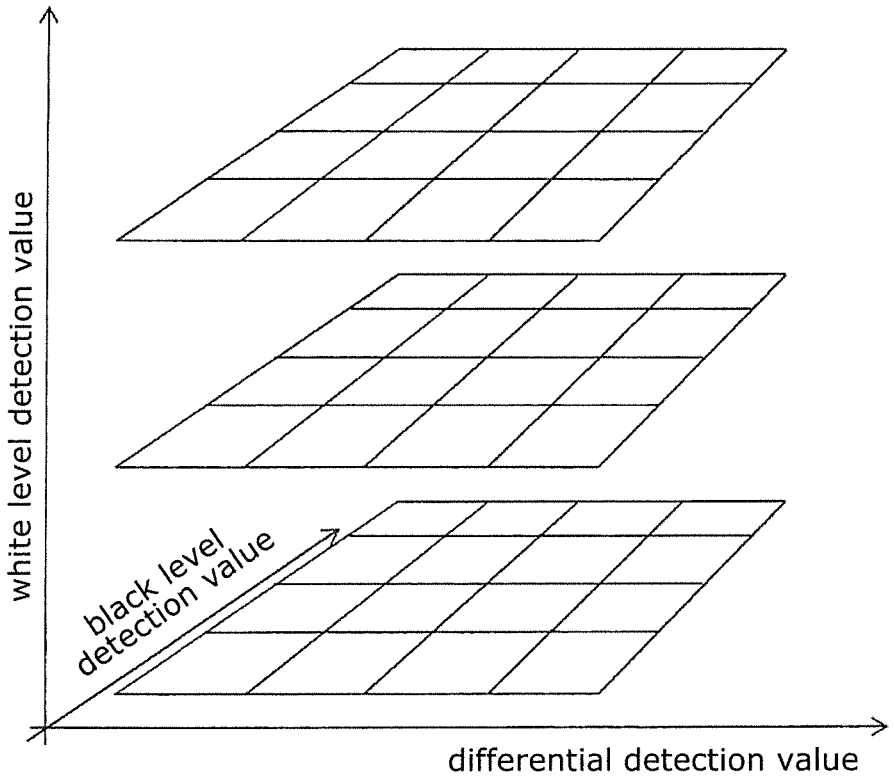
FIG. 11 is a conceptual diagram illustrating a look-up table used when a gain determination circuit of the exemplary embodiment determines a filter gain.

In the exemplary embodiment, as illustrated in FIG. 11, gain determination circuit 326 stores the output value from black level detection circuit 324, the output value from white level detection circuit 325, and a three-dimensional look-up table expressed by the differential detection value, and determines the filter gain using the look-up table. Specifically, in the example of FIG. 11, the look-up table has a 4×4×3 matrix structure in which the filter gain value is recorded in each element, and one filter gain value is determined according to the output value from black level detection circuit 324, the output value from white level detection circuit 325, and the differential detection value. In the example of FIG. 11, the look-up table has the 4×4×3 matrix. Alternatively, when higher calculation accuracy is required, the look-up table may further be subdivided.

As described above, the liquid crystal display device of the present disclosure can determine the filter coefficient of the low-pass filter processing performed by low-pass filter 333 according to the background level in the input image data, so that the more appropriate filter coefficient can be selected to further prevent the display defect due to the parallax.

Gain determination circuit 326 may be configured to determine not only the filter coefficient but also the filter size of low-pass filter processing (to be described later) according to the output value from background level detection circuit 323. For example, in human visual characteristics, a pupil is narrowed when a luminance level of a background is high, so that the gradation is hardly recognized in a region where the luminance level is low.

For this reason, when the luminance level of the background is high, the parallax in the region where the luminance level is low becomes difficult to understand, so that gain determination circuit 326 may be configured to reduce the filter size of low-pass filter 333.

When acquiring input image data Data, second image generator 331 generates the second image data corresponding to the second image using a maximum value (the R value, the G value, or the B value) in each color value (in this case, the RGB value [R value, G value, B value]) indicating the color information about input image signal Data. Specifically, in the RGB value corresponding to target pixel 214, second image generator 331 generates the monochrome image data by setting the maximum value in the RGB values to the value of target pixel 214. Second image generator 331 outputs the generated second image data to second gamma processor 332.

When acquiring the second image data generated by second image generator 331, second gamma processor 332 refers to a second gradation table to perform second gamma processing of determining a second gradation corresponding to the second image data. For example, second gamma processor 332 determines the gradation of the second image data using second gamma value $\gamma 2$ set based on a second gamma characteristic that is a gamma characteristic for second display panel 200. Second gamma processor 332 outputs the second image data subjected to the second gamma processing to low-pass filter 333.

In order to reduce the display defect due to the parallax, low-pass filter 333 performs low-pass filter processing of locally expanding a portion having a high signal level of the input image data Data by several pixels on the second image data subjected to the second gamma processing. At that point, as described above, low-pass filter 333 performs the low-pass filter processing using the filter gain determined by gain determination circuit 326 using the background level. As a result, low-pass filter 333 can perform the low-pass filter processing according to the background level in the input image data, and further prevent the display defect due to the parallax. Low-pass filter 333 outputs second image data DAT2 subjected to the low-pass filter processing to second timing controller 240. In the exemplary embodiment, low-pass filter 333 outputs second image data DAT2 subjected to the low-pass filter processing to first gamma processor 311.

When acquiring input image data Data, first gamma processor 311 refers to a first gradation table to perform first gamma processing of determining a first gradation corresponding to first image data DAT1. For example, first gamma processor 311 determines the gradation of first image data DAT1 using first gamma value γ1 set based on a first gamma characteristic that is a gamma characteristic for first display panel 100. First gamma processor 311 outputs first image data DAT1 subjected to the first gamma processing to first timing controller 140. First gamma processor 311 may determine the first gradation based on the second gradation of second image data DAT2 subjected to the second gamma processing by second gamma processor 332 and subjected to the low-pass filter processing by low-pass filter 333.

A method for setting first gamma value γ1 and second gamma value γ2 will be described below. For example, first gamma value γ1 and second gamma value γ2 are set such that a combined gamma value of a combined image obtained by combining the first image that is the color image and the second image that is the monochrome image is 2.2. For example, when both the first gamma characteristic of first display panel 100 and the second gamma characteristic of second display panel 200 have the gamma value of 2.2, assuming that Lm is luminance of first display panel 100 and that Ls is luminance of second display panel 200, combined luminance is given by Lm×Ls. When the combined luminance Lm×Ls is expressed by input image data Data, first gamma value γ1, and second gamma value γ2, the following equation is obtained.

$$Lm \times Ls = (\text{Data}\hat{}\gamma 1)\hat{}2.2 \times (\text{Data}\hat{}\gamma 2)\hat{}2.2$$

$$= \text{Data}\hat{}(\gamma 1 \times 2.2) \times \text{Data}\hat{}(\gamma 2 \times 2.2) =$$

$$\text{Data}\hat{}(\gamma 1 \times 2.2 + \gamma 2 \times 2.2)$$

Thus, when first gamma value γ1 and second gamma value γ2 are set such that (γ1+γ2)=1 is obtained, the combined gamma value can be set to 2.2.

Although the exemplary embodiments of the present disclosure are described above, the present disclosure is not limited to the exemplary embodiment. Needless to say, various modifications of the exemplary embodiment made appropriately by those in the art without departing from the scope of the present disclosure are also included in the technical scope of the present disclosure.

What is claimed is:

1. A liquid crystal display device that is a display device in which a plurality of display panels are disposed in a superposed manner and an image is displayed on each of the display panels, the liquid crystal display device comprising:

a first display panel that displays a first image;

a second display panel disposed on a back surface side of the first display panel to display a second image; and an image processor that acquires input image data and generates first image data corresponding to the first image and second image data corresponding to the second image based on the input image data, wherein the image processor includes:

a differential filter that performs differential filter processing on a luminance signal calculated from the input image data and outputs a differential detection value;

a background level detection circuit that detects a background level within a predetermined pixel range using the luminance signal;

a gain determination circuit that determines a filter gain using the differential detection value output from the differential filter and the background level detected by the background level detection circuit; and a low-pass filter that performs low-pass filter processing using the filter gain determined by the gain determination circuit, wherein the background level detection circuit includes:

a black level detection circuit that outputs a black level output value that increases as the input image data is closer to a black level; and a white level detection circuit that outputs a white level output value that increases as the input image data is closer to a white level, wherein the gain determination circuit determines the filter gain using the black level output value from the black level detection circuit and the white level output value from the white level detection circuit, and wherein the black level detection circuit:

converts a luminance signal value for each pixel into the black level;

obtains the black level output value by:

obtaining a first quotient by dividing a total value of the black level by a number of pixels having a value that is greater than a predetermined black level, obtaining a first product by multiplying the first product by weighting (α), obtaining a second quotient by dividing the total value of the black level by a number of pixels in the predetermined pixel range, obtaining a second product by multiplying the second quotient by weighting (1−α), and adding the first product and the second product; and outputs the black level output value.

2. The liquid crystal display device according to claim 1, wherein the gain determination circuit:

stores the output value from the black level detection circuit, the output value from the white level detection circuit, and a three-dimensional look-up table expressed by the differential detection value, and determines the filter gain using the three-dimensional look-up table.

3. The liquid crystal display device according to claim 1, wherein the white level detection circuit converts the value of luminance signal of each pixel into the white level, and outputs the total value of the white level within the predetermined pixel range.

4. The liquid crystal display device according to claim 1, wherein the white level detection circuit:

converts the value of luminance signal of each pixel into the white level, and outputs an average value obtained by dividing the total value of the white level by the number of pixels having the value larger than a predetermined white level output in each area.

5. The liquid crystal display device according to claim 1, wherein the white level detection circuit:

converts the luminance signal value for each pixel into the white level;

obtains the white level output value by:

obtaining a first quotient by dividing the total value of the white level by the number of pixels having a value greater than a predetermined white level, obtaining a first product by multiplying the first quotient by weighting (α), obtaining a second quotient by dividing the total value of the white level by the number of pixels in the predetermined pixel range, obtaining a second product by multiplying the second quotient by weighting (1−α), and adding the first product and the second product; and outputs the white level output value.

6. A liquid crystal display device that is a display device in which a plurality of display panels are disposed in a superposed manner and an image is displayed on each of the display panels, the liquid crystal display device comprising:

a first display panel that displays a first image;

a second display panel disposed on a back surface side of the first display panel to display a second image; and an image processor that acquires input image data and generates first image data corresponding to the first image and second image data corresponding to the second image based on the input image data, wherein the image processor includes:

a differential filter that performs differential filter processing on a luminance signal calculated from the input image data and outputs a differential detection value;

a background level detection circuit that detects a background level within a predetermined pixel range using the luminance signal;

a gain determination circuit that determines a filter gain using the differential detection value output from the differential filter and the background level detected by the background level detection circuit; and a low-pass filter that performs low-pass filter processing using the filter gain determined by the gain determination circuit, wherein the background level detection circuit includes:

a black level detection circuit that outputs a black level output value that increases as the input image data is closer to the black level; and a white level detection circuit that outputs a white level output value that increases as the input image data is closer to the white level, wherein the gain determination circuit determines the filter gain using the black level output value from the black level detection circuit and the white level output value from the white level detection circuit, and wherein the white level detection circuit:

converts the value of a luminance signal value for each pixel into the white level;

obtains the white level output value by:

obtaining a first quotient by dividing value for total value of the white level by the number of pixels having a value that is greater than a predetermined white level, obtaining a first product by multiplying the first product by weighting (α), obtaining a second quotient by dividing the total value of the white level by the number of pixels in the predetermined pixel range, obtaining a second product by multiplying the second quotient by weighting (1−α), and adding the first product and the second product; and outputs the white level output value.

* * * * *